US011238813B2

(12) United States Patent
Kuo

(10) Patent No.: US 11,238,813 B2
(45) Date of Patent: Feb. 1, 2022

(54) LUMINANCE COMPENSATION METHOD

(71) Applicant: PEGATRON CORPORATION, Taipei (TW)

(72) Inventor: Sheng-Fu Kuo, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 17/164,392

(22) Filed: Feb. 1, 2021

(65) Prior Publication Data

US 2021/0280151 A1 Sep. 9, 2021

(30) Foreign Application Priority Data

Mar. 4, 2020 (TW) ..... 109107072

(51) Int. Cl.
*G09G 3/34* (2006.01)
*G09G 5/10* (2006.01)

(52) U.S. Cl.
CPC ..... *G09G 3/3406* (2013.01); *G09G 5/10* (2013.01); *G09G 2320/064* (2013.01); *G09G 2320/0626* (2013.01); *G09G 2330/026* (2013.01); *G09G 2360/145* (2013.01); *G09G 2360/16* (2013.01)

(58) Field of Classification Search
CPC . G09G 3/3406–3426; G09G 2320/064; G09G 2320/0626; G09G 2330/026; G09G 2360/14–142; G09G 2360/145–148; G09G 2360/16
See application file for complete search history.

(56) References Cited

U.S. PATENT DOCUMENTS 7,375,711 B2 * 5/2008 Horiuchi ..... G09G 3/3233 345/89
8,552,930 B2 * 10/2013 Yamamoto ..... G09G 3/3648 345/52
2003/0058252 A1 * 3/2003 Matsuda ..... G09G 5/10 345/589

FOREIGN PATENT DOCUMENTS

CN 105575341 5/2016
CN 109946859 6/2019

* cited by examiner

*Primary Examiner* — Gene W Lee
(74) *Attorney, Agent, or Firm* — J.C. Patents

(57) ABSTRACT

A luminance compensation method is provided. The luminance compensation method includes: establishing a time-varying luminance sequence according to an average luminance value of a plurality of sampled display devices in each unit time during an initial start-up period; establishing an operating luminance sequence according to an average operating luminance value of the sampled display devices under a plurality of different driving condition values after the initial start-up period; generating a driving condition value look-up table according to the time-varying luminance sequence and the operating luminance sequence; and obtaining compensation driving condition values in each unit time according to the driving condition value look-up table and the time-varying luminance sequence and accordingly establishing a time-varying compensation sequence, such that a display device drives a backlight module according to the time-varying compensation sequence in each time unit during the initial start-up period.

9 Claims, 6 Drawing Sheets

$$\begin{bmatrix} TL_{1-0}, TL_{1-1}, \ldots, TL_{1-30} \\ TL_{2-0}, TL_{2-1}, \ldots, TL_{2-30} \\ TL_{3-0}, TL_{3-1}, \ldots, TL_{3-30} \\ TL_{4-0}, TL_{4-1}, \ldots, TL_{4-30} \\ \vdots \\ TL_{10-0}, TL_{10-1}, \ldots, TL_{10-30} \end{bmatrix}$$

TLM

FIG. 4A $$\{ATL_0, ATL_1, ATL_2, ATL_3, ATL_4, ATL_5, ATL_6, \ldots, ATL_{29}, ATL_{30}\}$$

ATLS

FIG. 4B $$\begin{bmatrix} DL_{1-0}, DL_{1-1}, \ldots, DL_{1-100} \\ DL_{2-0}, DL_{2-1}, \ldots, DL_{2-100} \\ DL_{3-0}, DL_{3-1}, \ldots, DL_{3-100} \\ DL_{4-0}, DL_{4-1}, \ldots, DL_{4-100} \\ \vdots \\ DL_{10-00}, DL_{10-01}, \ldots, DL_{10-100} \end{bmatrix}$$

DLM

FIG. 5A $$\{ADL_0, ADL_1, ADL_2, \ldots, ADL_{99}, ADL_{100}\}$$

ADLS

FIG. 5B $$\{DT_0, DT_1, DT_2, \ldots, DT_{338}, DT_{339}\}$$

DTS

FIG. 6

LUMINANCE COMPENSATION METHOD

CROSS-REFERENCE TO RELATED APPLICATION

This application claims the priority benefit of Taiwan application serial no. 109107072, filed on Mar. 4, 2020. The entirety of the above-mentioned patent application is hereby incorporated by reference herein and made a part of this specification.

BACKGROUND

Technical Field

The disclosure relates to a luminance compensation method, and in particular, relates to a luminance compensation method configured for a display device.

Description of Related Art

When a display device is turned on, the backlight module is not yet in a stable state. Generally, depending on manufacturing and electrical properties of each backlight module, the initial start-up periods required by backlight modules to reach a stable state vary slightly, and the initial start-up periods are usually 20 to 30 minutes long. As such, during the initial start-up period, not until the initial start-up period is over may a backlight module reach its predetermined luminance value. In other words, during the initial start-up period, the luminance of the backlight module is not stable. Therefore, when using the display after the display device is turned on, the user may notice that the luminance value is unstable. The instability of luminance during the initial start-up period may cause problems for professional users of computer graphics in particular.

SUMMARY

The disclosure provides a luminance compensation method through which luminance values of backlight modules in each unit time during an initial start-up period are close to be identical.

The luminance compensation method provided by the disclosure includes the following steps. According to a plurality of luminance values of a plurality of sampled display devices in each unit time during an initial start-up period, an average luminance value in each unit time is obtained and a time-varying luminance sequence is accordingly established. According to a plurality of operating luminance values of the sampled display devices under a plurality of different driving condition values after the initial start-up period, an average operating luminance value under each driving condition value is obtained, and an operating luminance sequence is accordingly established. A driving condition value look-up table is generated according to each driving condition value of the operating luminance sequence corresponding to each average luminance value of the time-varying luminance sequence in each unit time. Whether the average luminance value in each unit time during the initial start-up period is less than the average luminance value at ending of the initial start-up period is determined. A difference value between a driving condition value corresponding to a maximum average luminance value of the time-varying luminance sequence and a driving condition value corresponding to the average luminance value of the time-varying luminance sequence in the unit time is calculated according to the driving condition value look-up table, a driving condition value corresponding to a predetermined luminance value is added, a compensation driving condition value in the unit time is obtained, and a time-varying compensation sequence established under the compensation driving condition value in each unit time during the initial start-up period after compensation is accordingly generated when the average luminance value in the time unit is less than the average luminance value at ending of the initial start-up period, such that a backlight module of a display device is driven according to the time-varying compensation sequence in each unit time during the initial start-up period to provide luminance corresponding to the predetermined luminance value.

To sum up, in the disclosure, the sampled display devices are measured to establish the time-varying luminance sequence and the operating luminance sequence. The operating luminance sequence is converted to generate the driving condition value look-up table, and the time-varying compensation sequence is generated according to the driving condition value look-up table and the time-varying luminance sequence. Therefore, the display devices compensate the backlight modules of the display devices according to time-varying compensation sequence during the initial start-up period. In this way, in the disclosure, the luminance values of the backlight modules in each unit time during the initial start-up period are close to be identical.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

FIG. 4A illustrates a two-dimensional time-varying luminance array according to an embodiment of the disclosure.

FIG. 4B illustrates a time-varying luminance sequence according to an embodiment of the disclosure.

FIG. 5A illustrates a two-dimensional time-varying luminance array according to an embodiment of the disclosure.

FIG. 5B illustrates an operating luminance sequence according to an embodiment of the disclosure.

FIG. 6 illustrates a driving condition value look-up table according to an embodiment of the disclosure.

DESCRIPTION OF THE EMBODIMENTS

Figure 1:
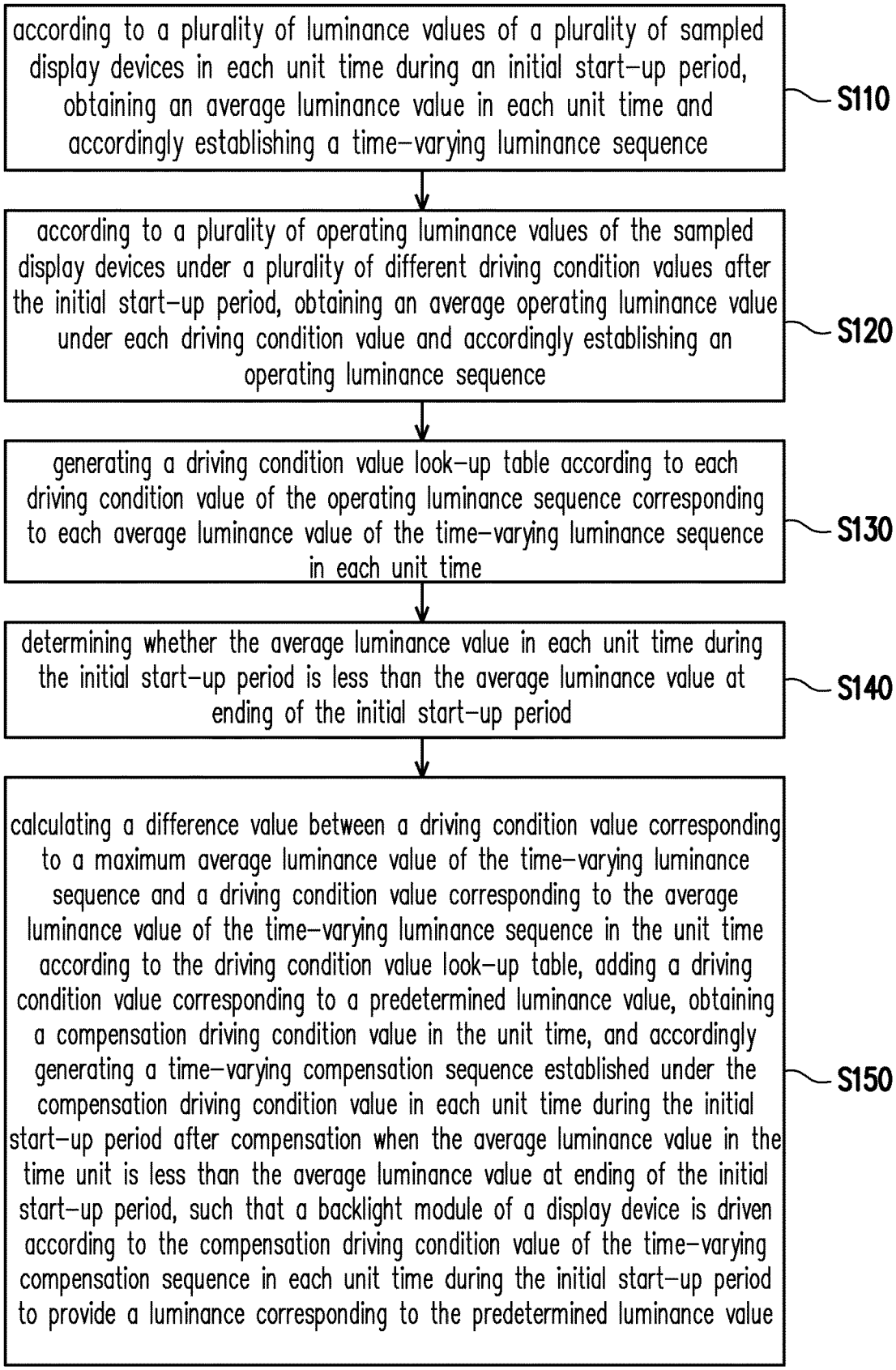
FIG. 1 is a method flow chart illustrating a luminance compensation method according to an embodiment of the disclosure.
Figure 2:
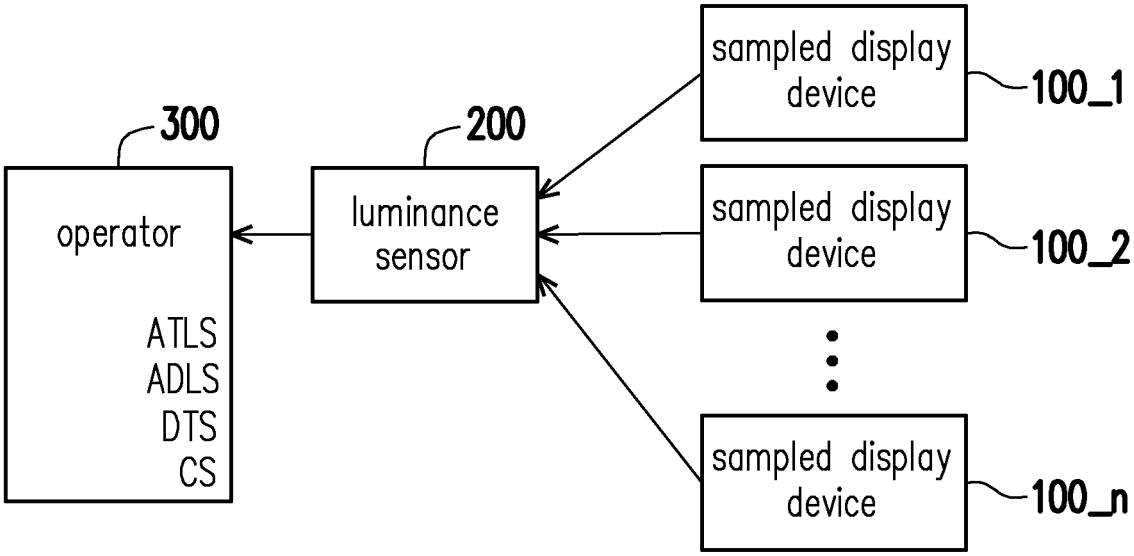
FIG. 2 is a schematic diagram illustrating luminance value measurement according to an embodiment of the disclosure.

With reference to FIG. 1 and FIG. 2 together, FIG. 1 is a method flow chart illustrating a luminance compensation method according to an embodiment of the disclosure. FIG. 2 is a schematic diagram illustrating luminance value measurement according to an embodiment of the disclosure. In the present embodiment, in step S110 of the luminance compensation method, according to a plurality of luminance values of a plurality of sampled display devices in each unit time during an initial start-up period, an average luminance value in each unit time is obtained, and a time-varying luminance sequence is accordingly established. In the present embodiment, sampled display devices 100_1 to **100_*n* are sampled among display devices of a same production batch. For instance, it is estimated that 100,000 display devices are provided in one single batch. 10 display devices may thus be sampled from the 100,000 devices to act as the sampled display devices 100_1 to 100_*n*. Next, the luminance values of the sampled display devices 100_1 to 100_*n* during the initial start-up period are measured. The sampled display devices 100_1 to 100_*n* are driven during the initial start-up period through a predetermined driving condition value. The predetermined driving condition value may be provided through an external driving device or may be provided by a control device built in each of the sampled display devices 100_1 to 100_*n*, which should however not be construed as limitations to the disclosure. In the present embodiment, the sampled display devices 100_1 to 100_*n* drive respective backlight modules through, for example, 80% of a duty cycle during the initial start-up period. The luminance values of the sampled display devices 100_1 to 100_*n* in different unit times of the initial start-up period are measured through a luminance sensor 200. In the present embodiment, the luminance sensor 200 may be a sensor such as a color display analyzer (CA-210). In the present embodiment, in step S110, the luminance sensor 200 may be configured to measure the luminance values in center positions of display regions of the sampled display devices 100_1 to 100_*n*. In some embodiments, the luminance sensor 200 may measure the luminance values in various positions of the display regions of the sampled display devices 100_1 to 100_*n***.

For instance, the initial start-up period is 30 minutes long. The unit time is, for example, 1 minute. The luminance value of the sampled display device 100_1 is measured every unit time after the initial start-up period starts. The luminance value of the sampled display device 100_1 is measured 1 minute after the initial start-up period starts, and the luminance value of the sampled display device 100_1 is measured again 2 minutes after the initial start-up period starts. The rest may be deduced by analogy, and such measurement does not end until the luminance value of the sampled display device 100_1 30 minutes after the initial start-up period starts is measured. Therefore, during the initial start-up period, the luminance value of the sampled display device 100_1 in every one minute is measured. Similarly, during the initial start-up period, the luminance values of the sampled display devices 100_2 to **100_*n* in every one minute are measured. The luminance sensor 200 may transmit the measured luminance values to an operator 300. The operator 300 may establish a time-varying luminance sequence ATLS according to the luminance values. For instance, the operator 300 may average the luminance values of the sampled display devices 100_1 to 100_*n* in each unit time during the initial start-up period, obtains the average luminance value in each unit time, and accordingly generates the time-varying luminance sequence ATLS. The operator 300** may be, for example, a central processing unit (CPU), a programmable microprocessor for general or special use, a digital signal processor (DSP), a programmable controller, an application specific integrated circuit (ASIC), a programmable logic device (PLD), or any other similar devices or a combination of the foregoing devices, and may be loaded to run a computer program.

In step S120, according to a plurality of operating luminance values of the sampled display devices under a plurality of different driving condition values after the initial start-up period, an average operating luminance value under each driving condition value is obtained, and an operating luminance sequence is accordingly established. In this embodiment, after the initial start-up period, the sampled display devices 100_1 to **100_*n* are driven through driving signals having various different driving condition values. In this embodiment, the predetermined driving condition value may be provided through an external driving device or may be provided by a control device built in each of the sampled display devices 100_1 to 100_*n*, which should however not be construed as limitations to the disclosure. In this embodiment, the different driving condition values may be 0% to 100% of the working cycle. That is, the sampled display devices 100_1 to 100_*n* are driven through driving signals having different working cycles. The sampled display devices 100_1 to 100_*n* may provide a high luminance when being driven by driving signals having high working cycles. The sampled display devices 100_1 to 100_*n* may provide a low luminance when being driven by driving signals having low working cycles. The sampled display devices 100_1 to 100_*n* drive respective backlight modules through 0% to 100% of the working cycle after the initial start-up period (that is, after 30 minutes). A plurality of operating luminance values of the sampled display devices 100_1 to 100_*n* generated through 0% to 100% of the working cycle after the initial start-up period may be measured through the luminance sensor 200. For instance, after the initial start-up period, the sampled display device 100_1 may drive the backlight module through 0%, 1%, . . . , and 100% of the working cycle. The luminance sensor 200 may measure the operating luminance values generated by the sampled display device 100_1 through 0%, 1%, . . . , and 100% of the working cycle in sequence. As such, the operating luminance values generated by the sampled display device 100_1 through the various driving condition values in a stable state are measured. Similarly, after the initial start-up period, the operating luminance values generated by the sampled display devices 100_2 to 100_*n* through the various driving condition values in the stable state are measured. In step S120, the luminance sensor 200 may be configured to measure the operating luminance values in the center positions of the display regions of the sampled display devices 100_1 to 100_*n*. In some embodiments, the luminance sensor 200 may measure the operating luminance values in various positions of the display regions of the sampled display devices 100_1 to 100_*n***.

In the present embodiment, the luminance sensor 200 may transmit the measured operating luminance values generated corresponding to the driving condition values to operator 300. The operator 300 may establish an operating luminance sequence ADLS according to the operating luminance values generated corresponding to the driving condition values. In the present embodiment, the operator 300 averages the operating luminance values of the sampled display devices 100_1 to **100_*n*** under each driving condition value after the initial start-up period, obtains the average operating luminance value of each driving condition value, and accordingly generates the operating luminance sequence ADLS.

In the present embodiment, step S110 and step S120 may be performed before shipping of the display devices of the same production batch as the sampled display devices 100_1 to **100_*n*. The sampled display devices 100_1 to 100_*n* may be sampled during, for example, the research and development stage, the manufacturing stage, and the quality assurance stage, so that step S110 and step S120 may be performed on the sampled display devices 100_1 to 100_*n***.

In step S130, a driving condition value look-up table is generated according to each driving condition value of identical or similar average operating luminance values in the operating luminance sequence corresponding to the average luminance value of the time-varying luminance sequence in each unit time. In this embodiment, the operator 300 obtains and converts each driving condition value of the operating luminance sequence ADLS corresponding to each average luminance value of the time-varying luminance sequence AILS in each unit time to generate a driving condition value look-up table DTS. In the driving condition value look-up table DTS, the driving condition values described above are at least included, such as 0%, 1%, . . . , and 100% of the working cycle. It thus can be seen that each driving condition value in the driving condition value look-up table may correspond to each average luminance value.

In step S140, whether the average luminance value in each unit time during the initial start-up period is less than the average luminance value at ending of the initial start-up period is determined. In the present embodiment, the operator 300 obtains a plurality of average luminance values corresponding to plural unit times from the time-varying luminance sequence AILS according to the different unit times during the initial start-up period and the average luminance values when at ending of the initial start-up period. The operator 300 may further determine whether the average luminance value corresponding to each unit time is less than the average luminance value at ending of the initial start-up period.

In step S150, when the average luminance value in the time unit is less than the average luminance value at ending of the initial start-up period, the difference value between the driving condition value corresponding to a maximum average luminance value of the time-varying luminance sequence and the driving condition value corresponding to the average luminance value of the time-varying luminance sequence in the unit time according to the driving condition value look-up table is calculated, the driving condition value corresponding to the predetermined luminance value is added, the compensation driving condition value in the unit time is obtained, and the time-varying compensation sequence established by the compensation driving condition value in each unit time during the initial start-up period after compensation is accordingly generated, such that a backlight module of a display device is driven according to the compensation driving condition value of the time-varying compensation sequence in each unit time during the initial start-up period to provide luminance corresponding to the predetermined luminance value. In this embodiment, the "driving condition value" is the number value of the working cycle. The driving condition is thereby quantified. The operator 300 may calculate the difference value between the driving condition value corresponding to the maximum average luminance value of the time-varying luminance sequence ATLS and the driving condition value corresponding to each average luminance value of the time-varying luminance sequence ATLS according to the driving condition value look-up table DTS, adds the driving condition value of the predetermined luminance value expected to be achieved, and accordingly generates a time-varying compensation sequence CS. The display devices receive the time-varying compensation sequence CS. The backlight module of the display device is driven according to the compensation driving condition value of the time-varying compensation sequence CS in each unit time during the initial start-up period to provide luminance corresponding to the predetermined luminance value. In the luminance compensation method provided by this embodiment, the luminance values of the backlight modules in each unit time during the initial start-up period are close to be identical. In this way, the luminance of the backlight modules during the initial start-up period is stable.

Figure 3:
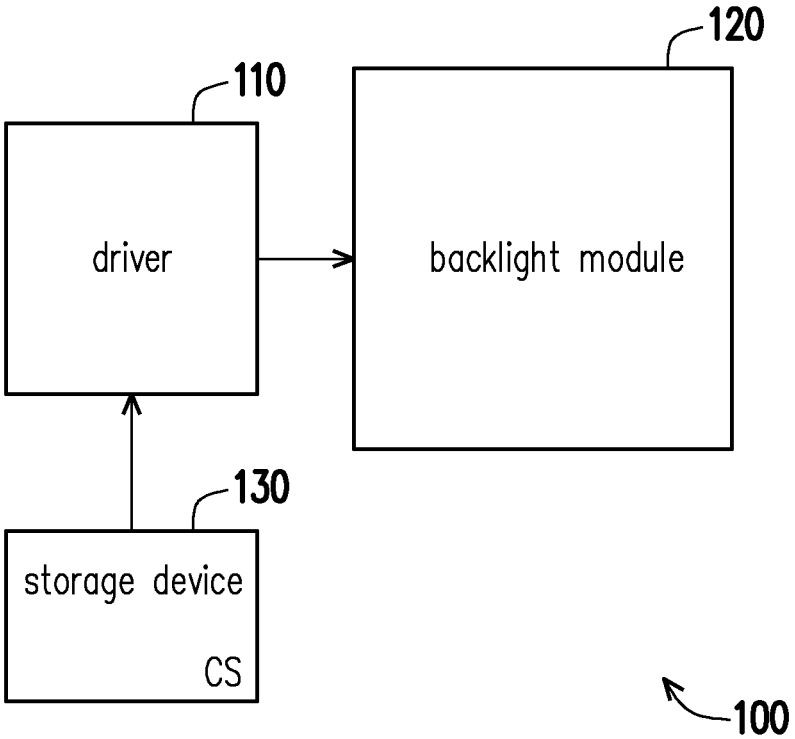
FIG. 3 is a device schematic diagram of a display device according to an embodiment of the disclosure.

Further, with reference to FIG. 2 and FIG. 3 together, FIG. 3 is a device schematic diagram of a display device according to an embodiment of the disclosure. In the present embodiment, a display device 100 includes a driver 110, a backlight module 120, and a storage device 130. The storage device 130 is configured to store the time-varying compensation sequence CS. The driver 110 is coupled to the backlight module 120 and the storage device 130. The driver 110 is configured to drive the backlight module 120 according to the time-varying compensation sequence CS stored by the storage device 130. In addition, the display device 100 and the sampled display devices 100_1 to **100_*n* belong to the same production batch. That is, a production condition of the backlight module 120 of the display device 100 is the same as production conditions of the backlight modules of the sampled display devices 100_1 to 100_*n*. Therefore, the time-varying compensation sequence CS is produced by the same production batch, so that the display device 100 is ensured to be configured for the sampled display devices 100_1 to 100_*n* to be associated with the time-varying compensation sequence CS. The time-varying compensation sequence CS used by the display device 100 is also used by the sampled display devices 100_1 to 100_*n***.

Implementation details of step S110 are specifically provided as follows. With reference to FIG. 2, FIG. 4A, and FIG. 4B together, FIG. 4A illustrates a two-dimensional time-varying luminance array according to an embodiment of the disclosure. FIG. 4B illustrates the time-varying luminance sequence ATLS according to an embodiment of the disclosure. In this embodiment, the operator 300 may integrate multiple luminance values to generate a two-dimensional time-varying luminance array TLM. That is, the luminance values of the sampled display devices 100_1 to **100_*n*** in each unit time during the initial start-up period are measured to generate the two-dimensional time-varying luminance array TLM. The two-dimensional time-varying luminance array TLM is a rectangular array including a plurality of rows and a plurality of columns.

In this embodiment, a total of 10 sampled display devices 100_1 to **100_*n* are provided. The initial start-up period is 30 minutes long. During the initial start-up period, the luminance values of the sampled display devices 100_2 to 100_*n* in every one minute (i.e., each unit time) are measured. Therefore, the two-dimensional time-varying luminance array TLM has 10 rows and 31 columns. The rows of the two-dimensional time-varying luminance array TLM correspond to time-varying luminance values $TL_{1-0}$ to $TL_{10-30}$ of the sampled display devices 100_1 to 100_*n* during the initial start-up period. A first row of the two-dimensional time-varying luminance array TLM records the time-varying luminance values $TL_{1-0}$ to $TL_{1-30}$ of the sampled display device 100_1 during the initial start-up period. A second row of the two-dimensional time-varying luminance array TLM records the time-varying luminance values $TL_{2-0}$ to $TL_{2-30}$ of the sampled display device 100_2 during the initial start-up period, and the rest may be deduced by analogy. The columns of the two-dimensional time-varying luminance array TLM correspond to the time-varying luminance values $TL_{1-0}$ to $TL_{10-30}$ of the sampled display devices 100_1 to 100_*n* in each time unit during the initial start-up period. A first column of the two-dimensional time-varying luminance array TLM records the time-varying luminance values $TL_{1-0}$ to $TL_{10-0}$ of the sampled display devices 100_1 to 100_*n* during the initial start-up period. A second column of the two-dimensional time-varying luminance array TLM records the time-varying luminance values $TL_{1-1}$ to $TL_{10-1}$ of the sampled display devices 100_1 to 100_*n* in a first minute during the initial start-up period. A third column of the two-dimensional time-varying luminance array TLM records the time-varying luminance values $TL_{1-2}$ to $TL_{10-2}$ of the sampled display devices 100_1 to 100_*n*** in a second minute during the initial start-up period, and the rest may be deduced by analogy.

Next, the rows of the two-dimensional time-varying luminance array TLM are averaged to generate the time-varying luminance sequence AILS. In this embodiment, the operator 300 may average 10 rows in the two-dimensional time-varying luminance array TLM to generate the time-varying luminance sequence AILS. In this embodiment, the operator 300 may average the time-varying luminance values $TL_{1-0}$, $TL_{2-0}$, . . . , and $TL_{10-0}$ of the two-dimensional time-varying luminance array TLM to generate an average luminance value $ATL_0$ of the time-varying luminance sequence AILS. The operator 300 may average the time-varying luminance values $TL_{1-1}$, $TL_{2-1}$, . . . , and $TL_{10-1}$ of the two-dimensional time-varying luminance array TLM to generate an average luminance value $ATL_1$ of the time-varying luminance sequence AILS, and the rest may be deduced by analogy. The time-varying luminance sequence AILS has average luminance values $ATL_1$ to $ATL_{30}$. Therefore, the time-varying luminance sequence AILS may reflect an average time-varying luminance tendency of the display devices (including the sampled display devices 100_1 to **100_*n***) of the same batch during the initial start-up period.

Implementation details of step S120 are specifically provided as follows. With reference to FIG. 2, FIG. 5A, and FIG. 5B together, FIG. 5A illustrates a two-dimensional operating luminance array according to an embodiment of the disclosure. FIG. 5B illustrates an operating luminance sequence ADLS according to an embodiment of the disclosure. In the present embodiment, after the initial start-up period, the luminance sensor 200 may measure the luminance values generated by the sampled display device 100_1 to **100_*n* which may be integrated by the operator 300 through 0%, 1%, . . . , and 100% of the working cycle in sequence to establish and generate a two-dimensional operating luminance array DLM. That is, the luminance values of the sampled display devices 100_1 to 100_*n*** under different driving condition values after the initial start-up period are measured to generate the two-dimensional operating luminance array DLM. The two-dimensional operating luminance array DLM is a rectangular array including a plurality of rows and a plurality of columns.

In this embodiment, the sampled display devices 100_1 to **100_*n* generate the luminance values through 0%, 1%, . . . , and 100% of the working cycle. Therefore, the two-dimensional operating luminance array DLM has 10 rows and 101 columns. The rows of the two-dimensional operating luminance array DLM correspond to operating luminance values $DL_{1-0}$ to $DL_{10-100}$ generated by the sampled display devices 100_1 to 100_*n* under different driving condition values (0%, 1%, . . . , and 100% of the working cycle). A first row of the two-dimensional operating luminance array DLM records the operating luminance values $DL_{1-0}$ to $DL_{1-100}$ of the sampled display device 100_1 during the initial start-up period. A second row of the two-dimensional operating luminance array DLM records the operating luminance values $DL_{2-0}$ to $DL_{2-100}$ of the sampled display device 100_2 during the initial start-up period, and the rest may be deduced by analogy. The columns of the two-dimensional operating luminance array DLM correspond to the time-varying luminance values $TL_{1-0}$ to $TL_{10-30}$ of the sampled display devices 100_1 to 100_*n* in each time unit during the initial start-up period. A first column of the two-dimensional operating luminance array DLM records the operating luminance values $DL_{1-0}$ to $DL_{10-0}$ generated by the sampled display devices 100_1 to 100_*n* through 0% of the working cycle. A second column of the two-dimensional operating luminance array DLM records the operating luminance values $DL_{1-1}$ to $DL_{10-1}$ generated by the sampled display devices 100_1 to 100_*n* through 1% of the working cycle. A third column of the two-dimensional operating luminance array DLM records the operating luminance values $DL_{1-2}$ to $DL_{10-2}$ generated by the sampled display devices 100_1 to 100_*n*** through 2% of the working cycle, and the rest may be deduced by analogy.

Next, the rows of the two-dimensional operating luminance array DLM are averaged to generate the operating luminance sequence ADLS. In this embodiment, the operator 300 may average 10 rows in the two-dimensional operating luminance array DLM to generate the operating luminance sequence ADLS. In this embodiment, the operator 300 may average the operating luminance values $DL_{1-0}$, $DL_{2-0}$, . . . , and $DL_{10-0}$ of the two-dimensional operating luminance array DLM to generate an average operating luminance value $ADL_0$ of the operating luminance sequence ADLS. The operator 300 may average the operating luminance values $DL_{1-1}$, $DL_{2-1}$, . . . , and $DL_{10-1}$ of the two-dimensional operating luminance array DLM to generate an average operating luminance value ADL 1 of the operating luminance sequence ADLS, and the rest may be deduced by analogy. The operating luminance sequence ADLS has average operating luminance values $ADL_0$ to $ADL_{100}$. Therefore, the operating luminance sequence ADLS may reflect a luminance value average tendency corresponding to the working cycle of the display devices (including the sampled display devices 100_1 to **100_*n***) of the same batch.

With reference to FIG. 2, FIG. 5B, and FIG. 6 together, FIG. 6 illustrates a driving condition value look-up table according to an embodiment of the disclosure. According to the driving condition value look-up table generated by each unit time, the average luminance value, the average operating luminance value, and the driving condition value, the average operating luminance value identical to the average luminance value may be found in the operating luminance sequence according to the average luminance value, and the corresponding driving condition value may thus be found. Nevertheless, if the driving condition value corresponding to a specific average luminance value is to be found, but an average operating luminance value having the same value of such average luminance value is not found and a value between the two average operating luminance values is found instead, an interpolation method may be further implemented to calculate and obtain the corresponding driving condition.

In the present embodiment, expected luminance values are, for example, 0 cd/m$^2$, 1 cd/m$^2$, 2 cd/m$^2$, . . . , and 339 cd/m$^2$. Therefore, 340 expected luminance values are provided. Note that a total of 101 driving condition values are provided. The number of the expected luminance values is greater than the number of the driving condition values. Therefore, in order to set each of the expected luminance values in a numerical range of the average operating luminance value to have one corresponding driving condition value, that is, the number of the driving condition values in the driving condition value look-up table is allowed to be equal to the number of the expected luminance values, in step S130 in FIG. 1, interpolation calculation may be performed the operator 300 on the driving condition values according to the number of the expected luminance values, so that the number of the driving condition values of the driving condition value look-up table DTS may be set to be equal to the number of the expected luminance values. In this embodiment, the driving condition value look-up table DTS has driving condition values $DT_0$ to $DT_{399}$. The driving condition value $DT_0$ corresponds to the expected luminance value of 0 cd/m$^2$. The driving condition value $DT_1$ corresponds to the expected luminance value of 1 cd/m$^2$. The driving condition value $DT_2$ corresponds to the expected luminance value of 2 cd/m$^2$, and the rest may be deduced by analogy. Based on the above, the driving condition value look-up table is generated "according to each driving condition value of the operating luminance sequence corresponding to each average luminance value of the time-varying luminance sequence in each unit time". The expected luminance value in the embodiment acts as an example when no driving condition value corresponding to the average luminance value is found in the driving condition value look-up table.

Figure 7:
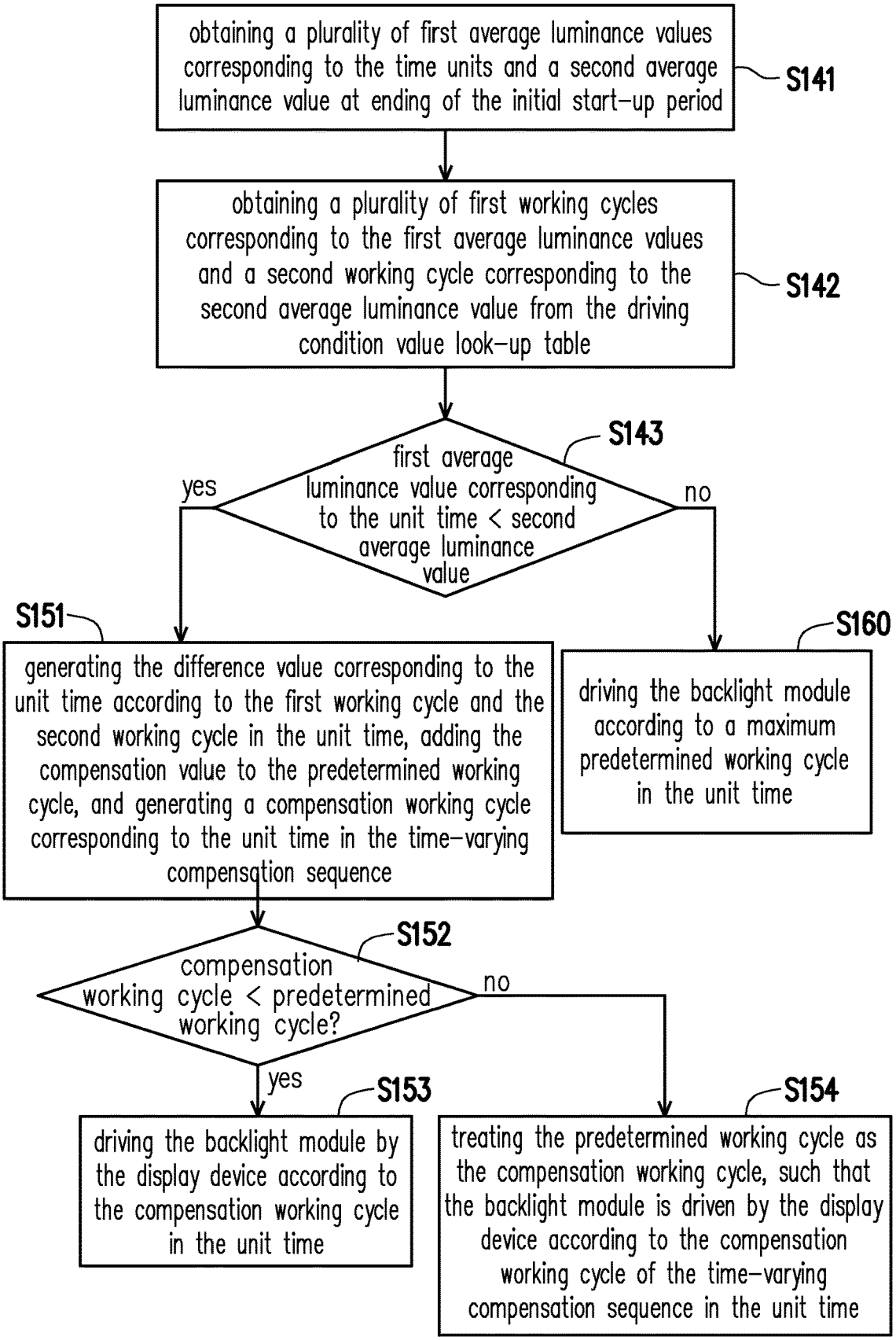
FIG. 7 is a flow chart illustrating a method of obtaining compensation driving condition values according to an embodiment of the disclosure.

With reference to FIG. 2, FIG. 3, and FIG. 7, FIG. 7 is a flow chart illustrating a method of obtaining compensation driving condition values according to an embodiment of the disclosure. In the present embodiment, the operator 300 obtains a plurality of first average luminance values corresponding to plural unit times and a second average luminance value at ending of the initial start-up period in step S141. In step S142, the operator 300 may obtain a plurality of first working cycles corresponding to the first average luminance values and a second working cycle corresponding to the second average luminance value from the driving condition value look-up table DTS and obtains a predetermined working cycle corresponding to the predetermined luminance value from the driving condition value look-up table DTS. In step S143, the operator 300 may determine whether the first average luminance value corresponding to the unit time is less than the second average luminance value (e.g., the maximum average luminance value, which should not be construed as limitations to the disclosure). Step S141 to step S143 provided by this embodiment may be included in step S140 in FIG. 1. When the first average luminance value is less than the second average luminance value, it means that the backlight module 120 is required to be compensated in the unit time during the initial start-up period. As such, step S151 of the method flow is performed.

In step S151, the operator 300 may generate a difference value corresponding to the unit time according to the first working cycle and the second working cycle in the unit time. The operator 300 may subtract the first working cycle from the second working cycle to generate the difference value. In step S151, the operator 300 may further add the difference value to the predetermined working cycle to generate a first compensation working cycle of the time-varying compensation sequence CS corresponding to the unit time. The operator 300 may obtain the predetermined working cycle corresponding to the predetermined luminance value from the driving condition value look-up table DTS. For instance, the predetermined luminance value may be 322 cd/m$^2$. The predetermined working cycle corresponding to the predetermined luminance value of 322 cd/m$^2$ obtained by the operator 300 from the driving condition value look-up table DTS is 80%, which should however not be construed as limitations to the disclosure The predetermined working cycle may be equal to the working cycle of the predetermined driving condition value as described in step S110.

After the time-varying compensation sequence CS is generated, step S152 of the method flow is performed. In step S152, the operator 30 may determine whether the compensation working cycle is less than a maximum predetermined working cycle. In the present embodiment, the maximum predetermined working cycle is configured to be a maximum rated working cycle configured to drive the backlight module 120. For instance, the maximum rated working cycle is 100% or 98%, which should however not be construed as limitations to the disclosure. When the compensation working cycle is less than the maximum predetermined working cycle, step S153 of the method flow is performed. In step S153, the operator 300 loads the compensation working cycle into the time-varying compensation sequence CS. As such, in the unit time during the initial start-up period, the backlight module 120 is driven by the display device 100 according to the first compensation working cycle of the time-varying compensation sequence CS in the unit time.

In contrast, in step S152, when the compensation working cycle is greater than or equal to the maximum predetermined working cycle, step S154 of the method flow is performed. In step S154, the operator 300 loads the maximum predetermined working cycle into the time-varying compensation sequence CS. As such, in the unit time during the initial start-up period, the backlight module 120 is driven by the display device 100 according to the maximum predetermined working cycle (e.g., 100% of the working cycle) in the unit time. Step S151 to step S154 provided by this embodiment may be included in step S150 in FIG. 1.

With reference to step S142 again, when the first average luminance value is greater than or equal to the second average luminance value, it means that the backlight module 120 is not required to be compensated in the unit time during the initial start-up period. As such, step S160 of the method flow is performed. In step S160, when the first average luminance value is greater than or equal to the second average luminance value, the operator 300 treats the predetermined working cycle (e.g., 80% of the working cycle) as the compensation working cycle in the unit time in the time-varying compensation sequence CS and loads the predetermined working cycle into the time-varying compensation sequence CS. As such, in the unit time during the initial start-up period, the backlight module 120 is driven by the display device 100 according to the compensation working cycle (e.g., 80% of the working cycle) in the time-varying compensation sequence CS in the unit time.

For instance, the unit time when the initial start-up period starts is treated as the unit time (i.e., the $0^{th}$ minute), the first average luminance value obtained by the operator 300 corresponding to the unit time is 311 cd/m$^2$. The second average luminance value is 320 cd/m$^2$. The operator 300 determines that the first average luminance value is less than the second average luminance value in step S142. Therefore, in step S151, the operator 300 may subtract the first working cycle (e.g., 68% of the working cycle) corresponding to the first average luminance value from the second working cycle (e.g., 77% of the working cycle) corresponding to the second average luminance value to generate a difference value, that is, a different value of 9%. The operator 300 obtains a difference value of 9%. Further, the difference value is added to the predetermined working cycle to generate the compensation working cycle, that is, 89% of the working cycle. Next, the operator 300 determines that the compensation working cycle (i.e., 89% of the working cycle) is less than the maximum predetermined working cycle (i.e., 100% of the working cycle) in step S152. Therefore, in step S153, the display device 100 drives the backlight module 120 in the unit time (the $0^{th}$ minute) when the initial start-up period starts through 89% of the working cycle.

For another instance, the 1st minute during the initial start-up period is treated as the unit time, the first average luminance value obtained by the operator 300 corresponding to the unit time is 320 cd/m$^2$. The second average luminance value is 320 cd/m$^2$. The operator 300 determines that the first average luminance value is equal to the second average luminance value in step S142. It thus can be seen that the backlight module 120 is not required to be compensated in the first minute during the initial start-up period 1. The operator 300 may treat the predetermined working cycle as the compensation working cycle in step S160. As such, during the initial start-up period, the display device 100 drives the backlight module 120 in the first minute through 80% of the working cycle.

For still another instance, the 2nd minute during the initial start-up period is treated as the unit time, the first average luminance value obtained by the operator 300 corresponding to the unit time is 311 cd/m$^2$. The second average luminance value is 320 cd/m$^2$. The operator 300 determines that the first average luminance value is less than the second average luminance value in step S142. Therefore, in step S151, the operator 300 may subtract the first working cycle (e.g., 56% of the working cycle) corresponding to the first average luminance value from the second working cycle (e.g., 77% of the working cycle) corresponding to the second average luminance value to generate a difference value, that is, a different value of 21%. The operator 300 may obtain a difference value of 21%. Further, the difference value is added to the predetermined working cycle to generate the compensation working cycle, that is, 101% of the working cycle. Next, the operator 300 determines that the compensation working cycle (i.e., 101% of the working cycle) is greater than the maximum predetermined working cycle (i.e., 100% of the working cycle) in step S152. Therefore, in step S154, the display device 100 drives the backlight module 120 in the 2nd minute during the initial start-up period through 100% of the working cycle.

Figure 8:
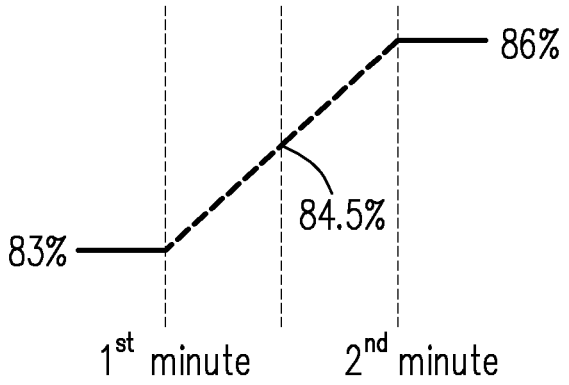
FIG. 8 is a schematic diagram illustrating producing of an interpolated compensation working cycle according to an embodiment of the disclosure.

With reference to FIG. 3 and FIG. 8 together, FIG. 8 is a schematic diagram illustrating producing of an interpolated compensation working cycle according to an embodiment of the disclosure. For instance, according to the time-varying compensation sequence CS, the first compensation working cycle of the display device 100 in the 1st minute during the initial start-up period is 83%. The second compensation working cycle in the 2nd minute adjacent to the 1st minute during the initial start-up period is 86%. Under this circumstance, an absolute value of a difference value between the first compensation working cycle and the second compensation working cycle is greater than a threshold value (e.g., 2%, which should however not be construed as limitations to the disclosure). A user may experience an unfavorable visual experience of flickering in the 2nd minute. Therefore, in this embodiment, the operator 300 may determine whether the absolute value of the difference value between the first compensation working cycle and the second compensation working cycle corresponding to adjacent unit times during the initial start-up period is greater than the threshold value. When the absolute value of the difference value between the first compensation working cycle and the second compensation working cycle is greater than the threshold value, the operator 300 may add at least one interpolated unit time between adjacent unit times (the 1st minute and the 2nd minute) in the time-varying compensation sequence CS and generates an interpolated compensation working cycle corresponding to the at least one interpolated unit time. One single interpolated unit time of 1.5 minutes is taken as an example herein. The interpolated compensation working cycle is between the first compensation working cycle and the second compensation working cycle. The interpolated compensation working cycle is, for example, 84.5%. Therefore, an absolute value (i.e., 1.5%) of a difference value between the interpolated compensation working cycle and the first compensation working cycle is less than the threshold value. An absolute value (i.e., 1.5%) of a difference value between the interpolated compensation working cycle and the second compensation working cycle is less than the threshold value. In this way, a user may not experience an unfavorable visual experience of flickering.

In view of the foregoing, in the disclosure, the sampled display devices are measured to establish the time-varying luminance sequence and the operating luminance sequence. The operating luminance sequence is converted to generate the driving condition value look-up table, and the time-varying compensation sequence is generated according to the driving condition value look-up table and the time-varying luminance sequence. Therefore, the display devices compensate the backlight modules of the display devices according to time-varying compensation sequence during the initial start-up period. In this way, in the disclosure, the luminance values of the backlight modules in each unit time during the initial start-up period are close to be identical.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A luminance compensation method, comprising:

according to a plurality of luminance values of a plurality of sampled display devices in each unit time during an initial start-up period, obtaining an average luminance value in each unit time and accordingly establishing a time-varying luminance sequence;

according to a plurality of operating luminance values of the sampled display devices under a plurality of different driving condition values after the initial start-up period, obtaining an average operating luminance value under each driving condition value and accordingly establishing an operating luminance sequence;

generating a driving condition value look-up table according to each driving condition value of the operating luminance sequence corresponding to each average luminance value of the time-varying luminance sequence in each unit time; and determining whether the average luminance value in each unit time during the initial start-up period is less than the average luminance value at ending of the initial start-up period;

calculating a difference value between a driving condition value corresponding to a maximum average luminance value of the time-varying luminance sequence and a driving condition value corresponding to the average luminance value of the time-varying luminance sequence in the unit time according to the driving condition value look-up table, adding a driving condition value corresponding to a predetermined luminance value, obtaining a compensation driving condition value in the unit time, and accordingly generating a time-varying compensation sequence established under the compensation driving condition value in each unit time during the initial start-up period after compensation when the average luminance value in the time unit is less than the average luminance value at ending of the initial start-up period, such that a backlight module of a display device is driven according to the time-varying compensation sequence in each unit time during the initial start-up period to provide luminance corresponding to the predetermined luminance value.

2. The luminance compensation method according to claim 1, wherein the display device and the sampled display devices belong to a same production batch.

3. The luminance compensation method according to claim 1, wherein the step of according to the luminance values of the sampled display devices in each unit time during the initial start-up period, obtaining the average luminance value in each unit time and accordingly establishing the time-varying luminance sequence further comprises:

measuring the luminance values of the sampled display devices in each unit time during the initial start-up period; and averaging the luminance values of the sampled display devices in each unit time during the initial start-up period, obtaining the average luminance value in each unit time, and accordingly generating the time-varying luminance sequence.

4. The luminance compensation method according to claim 1, wherein the step of according to the operating luminance values of the sampled display devices under the different driving condition values after the initial start-up period, obtaining the average operating luminance value under each driving condition value and accordingly establishing the operating luminance sequence further comprises:

measuring the operating luminance values of the sampled display devices under different driving condition values after the initial start-up period; and averaging the operating luminance values of the sampled display devices under each driving condition value after the initial start-up period, obtaining the average operating luminance value under the driving condition value, and accordingly generating the operating luminance sequence.

5. The luminance compensation method according to claim 1, wherein the driving condition values are a plurality of working cycles.

6. The luminance compensation method according to claim 5, wherein the step of determining whether the average luminance value in each unit time during the initial start-up period is less than the average luminance value at ending of the initial start-up period further comprises:

obtaining a plurality of first average luminance values corresponding to the time units from the time-varying luminance sequence according to the different unit times during the initial start-up period and a second average luminance value at ending of the initial start-up period;

obtaining a plurality of first working cycles corresponding to the first average luminance values and a second working cycle corresponding to the second average luminance value from the driving condition value look-up table; providing one of the first average luminance values to act as the predetermined luminance value; and obtaining a predetermined working cycle corresponding to the predetermined luminance value from the driving condition value look-up table.

7. The luminance compensation method according to claim 6, wherein the step of calculating the difference value between the driving condition value corresponding to the maximum average luminance value of the time-varying luminance sequence and the driving condition value corresponding to the average luminance value of the time-varying luminance sequence in the unit time according to the driving condition value look-up table, adding the driving condition value corresponding to the predetermined luminance value, obtaining the compensation driving condition value in the unit time, and accordingly generating the time-varying compensation sequence established under the compensation driving condition value in each unit time during the initial start-up period after compensation when the average luminance value in the time unit is less than the average luminance value at ending of the initial start-up period further comprises:

generating the difference value corresponding to the unit time according to the first working cycle and the second working cycle in the unit time, adding the difference value to the predetermined working cycle, and generating a compensation working cycle corresponding to the unit time in the time-varying compensation sequence when the first average luminance value in the unit time is less than the second average luminance value at ending of the initial start-up period.

8. The luminance compensation method according to claim 7, further comprising:

treating the predetermined working cycle as the compensation working cycle in the unit time in the time-varying compensation sequence when the first average luminance value corresponding to the unit time is greater than or equal to the second average luminance value, such that the backlight module is driven according to the compensation working cycle of the time-varying compensation sequence in the unit time.

9. The luminance compensation method according to claim 7, wherein a step of calculating the difference value between the second working cycle corresponding to the maximum average luminance value of the time-varying luminance sequence and the first working cycle corresponding to the average luminance value in the unit time according to the driving condition value look-up table, adding the predetermined working cycle corresponding to the predetermined luminance value, obtaining the compensation working cycle in the unit time, and accordingly generating the time-varying compensation sequence established by the compensation working cycle in each unit time during the initial start-up period after compensation when the first average luminance value corresponding to the time unit is less than the second average luminance value further comprises:

driving the backlight module according to the compensation working cycle of the time-varying compensation sequence in the unit time when the compensation working cycle is less than a maximum predetermined working cycle; and driving the backlight module according to the maximum predetermined working cycle in the unit time when the compensation working cycle is greater than or equal to the maximum predetermined working cycle.

* * * * *